US007498544B2

(12) United States Patent
Saijo et al.

(10) Patent No.: US 7,498,544 B2
(45) Date of Patent: Mar. 3, 2009

(54) FIRING FURNACE AND METHOD FOR MANUFACTURING POROUS CERAMIC FIRED OBJECT WITH FIRING FURNACE

(75) Inventors: Takamitsu Saijo, Gifu (JP); Koji Higuchi, Gifu (JP)

(73) Assignee: IBIDEN Co., Ltd., Ogaki-shi, Gifu (JP)

( * ) Notice: Subject to any disclaimer, the term of this patent is extended or adjusted under 35 U.S.C. 154(b) by 312 days.

(21) Appl. No.: 11/313,733

(22) Filed: Dec. 22, 2005

(65) Prior Publication Data

US 2006/0245465 A1 Nov. 2, 2006

Related U.S. Application Data

(63) Continuation of application No. PCT/JP2005/014317, filed on Aug. 4, 2005.

(30) Foreign Application Priority Data

Aug. 25, 2004 (JP) ..... 2004-245765

(51) Int. Cl.
*H05B 3/42* (2006.01)
*F27B 9/36* (2006.01)
*F27D 11/02* (2006.01)

(52) U.S. Cl. ..... 219/402; 219/388; 219/408; 219/411; 219/541; 373/128

(58) Field of Classification Search ..... None
See application file for complete search history.

(56) References Cited

U.S. PATENT DOCUMENTS 1,742,286 A * 1/1930 Shaw ..... 373/130
3,737,553 A * 6/1973 Kreider et al. ..... 373/130
4,135,053 A * 1/1979 Kastilahn et al. ..... 373/128
4,410,796 A * 10/1983 Wilsey ..... 117/210
5,459,748 A * 10/1995 Gleichman et al. ..... 373/132

FOREIGN PATENT DOCUMENTS

| | | |
|---|---|---|
| JP | 60-111500 | 7/1984 |
| JP | 60-111500 | 7/1985 |
| JP | 63-302291 | 12/1988 |

(Continued)

OTHER PUBLICATIONS

PCT International Preliminary Report on Patentability dated Mar. 8, 2007, issued in counterpart PCT Application No. PCT/JP2005/014317.

*Primary Examiner*—Joseph M Pelham
(74) *Attorney, Agent, or Firm*—Nixon & Vanderhye PC

(57) ABSTRACT

A firing furnace having a structure, which prolongs the durability of an insulative member, includes a plurality of heat generation bodies, arranged in the housing, for generating heat with power supplied from an external power supply, a connection member for connecting the external power supply and the heat generation bodies, a fixing member attached to the housing and including an insertion hole for receiving the connection member, an insulative member for sealing the space between the insertion hole and the connection member, and a restriction structure for restricting a flow of gas produced in the housing directed through a gap between the fixing member and the connection member and toward the insulative member.

29 Claims, 5 Drawing Sheets

FOREIGN PATENT DOCUMENTS

| | | |
|---|---|---|
| JP | 1-290562 | 11/1989 |
| JP | 10-52618 | 2/1998 |
| JP | 2001-48657 | 2/2001 |
| JP | 2002-20173 | 1/2002 |
| JP | 2002-20174 | 1/2002 |
| JP | 2002-97076 | 4/2002 |
| JP | 2002-193670 | 7/2002 |
| JP | 2002-226271 | 8/2002 |
| JP | 2002-249385 | 9/2002 |
| JP | 2003-314964 | 11/2003 |

* cited by examiner

FIRING FURNACE AND METHOD FOR MANUFACTURING POROUS CERAMIC FIRED OBJECT WITH FIRING FURNACE

CROSS-REFERENCE TO RELATED APPLICATIONS

This application is a continuation of, and claims the benefit of priority from International PCT Application PCT/JP2005/014317, filed on Aug. 4, 2005, claiming priority from Japanese Patent Application No. 2004-245765, filed on Aug. 25, 2004, the entire contents of which are incorporated herein by reference.

BACKGROUND OF THE INVENTION

The present invention relates to a firing furnace, and more particularly, to a resistance-heating firing furnace for firing a molded product of a ceramic material and a method for manufacturing a porous ceramic fired object using such a firing furnace.

A molded product of a ceramic material is typically fired in a resistance-heating firing furnace at a relatively high temperature. An example of a resistance-heating firing furnace is disclosed in JP-A 2002-193670. This firing furnace includes a plurality of rod heaters arranged in a firing chamber (muffle) for firing a molded product. A material having superior heat-resistance is used for the resistance-heating firing furnace to enable firing at high temperatures. In the conventional firing furnace, electric current is supplied to the rod heaters to generate heat. The radiation heat from the rod heaters heats and sinters the molded product in the firing chamber to manufacture a ceramic sinter.

A conventional resistance-heating firing furnace includes a power feeding unit for feeding power to a heater. As shown in FIG. 7, a power feeding unit 100 includes a connector 101 for connecting an electrode member 104, which is connected to an external power supply, to a heater 105, a fixing member 102 for covering the connector 101, and an insulative member 103 for electrically insulating the connector 101 and the fixing member 102. The firing furnace has a housing with an inner wall along which a heat insulative layer 106 is applied. In part of the heat insulative layer 106, a through hole **106*a* is formed to receive the power feeding unit 100. The fixing member 102 of the power feeding unit 100 is fitted to the through hole 106*a*. An insertion hole 107 is formed in the fixing member 102 for insertion of the connector 101. The insulative member 103, which is annular, is held between the wall of the insertion hole 107 and the connector 101 to electrically insulate the wall of the insertion hole and the connector 101**. The contents of JP-A 2002-193670 are incorporated herein by reference in their entirety.

SUMMARY OF THE INVENTION

One aspect of the present invention provides a firing furnace, connected to an external power supply, for firing a firing subject. The firing furnace includes a housing including a firing chamber for accommodating the firing subject, a plurality of heat generation bodies arranged in the housing for generating heat with power supplied from the external power supply to heat the firing subject in the firing chamber, a connection member for connecting the external power supply and each heat generation body, a fixing member attached to the housing and including an insertion hole for receiving the connection member, an insulative member for sealing a space between the insertion hole and the connection member, and a restriction structure for restricting a flow of gas produced in the housing and directed through a gap between the fixing member and the connection member toward the insulative member.

Another aspect of the present invention is a method for manufacturing a porous ceramic fired object, the method including forming a firing subject from a composition containing ceramic powder, and firing the firing subject with a firing furnace that includes a housing having a firing chamber for accommodating the firing subject, a plurality of heat generation bodies arranged in the housing for generating heat with power supplied from an external power supply to heat the firing subject in the firing chamber, a connection member for connecting the external power supply and each heat generation body, a fixing member attached to the housing and including an insertion hole for receiving the connection member, an insulative member for sealing a space between the insertion hole and the connection member, and a restriction structure for restricting a flow of gas produced in the housing directed through a gap between the fixing member and the connection member and toward the insulative member.

The restriction structure is configured so as to restrict the flow of gas produced in the housing that enters the gap between the fixing member and the connection member. In one embodiment, the restriction structure is arranged so that the insulative member is hidden behind the restriction structure when viewed from an inner side of the housing. In one embodiment, the restriction structure includes at least one of a projection formed on an outer surface of the connection member and a projection formed on an inner surface of the fixing member. In one embodiment, the restriction structure is a projection formed on the outer surface of the connection member and projects towards the inner surface of the fixing member. In one embodiment, the restriction structure includes a projection extending along the outer surface of the connection member in the circumferential direction and a projection formed along the entire circumference of the inner surface of the fixing member. In one embodiment, the restriction structure is configured to partially reduce the gap between the fixing member and the connection member.

It is preferred that the housing includes a heat insulative layer, and the insulative member is arranged outward from the heat insulative layer. It is preferred that the housing includes a heat insulative layer, with part of the fixing member, the insulative member, and one end of the connection member being arranged outward from the heat insulative layer. It is preferred that the housing includes a heat insulative layer, the fixing member has an end arranged outward from the heat insulative layer, the end includes an inwardly extending lip for supporting the insulative member at a location outward from the heat insulative layer, and the restriction structure includes the inward lip.

It is preferred that the insulative member is separated from the heat insulative layer by about 10 to about 100 mm. In one embodiment, a continuous firing furnace for continuously firing a plurality of the firing subjects is provided.

DETAILED DESCRIPTION OF THE PREFERRED EMBODIMENTS

A firing furnace according to a preferred embodiment of the present invention will now be described.

Figure 1:
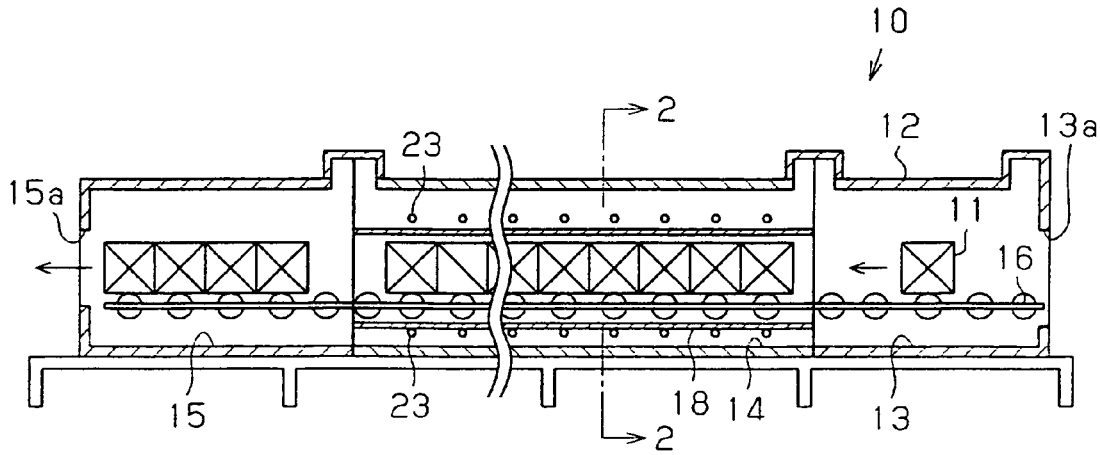
FIG. 1 is a schematic cross-sectional view of a firing furnace according to a first embodiment of the present invention.

FIG. 1 shows a firing furnace 10 used in a manufacturing process of a ceramic product. The firing furnace 10 includes a housing 12 having a loading port 13*a* and an unloading port 15*a*. Firing subjects 11 are loaded into the housing 12 through the loading port 13*a*, and conveyed from the loading port 13*a* towards the unloading port 15*a*. The firing furnace 10 is a continuous firing furnace for continuously firing the firing subjects 11 in the housing 12. An example of a raw material for the firing subjects is ceramics such as porous silicon carbide (SiC), silicon nitride (SiN), sialon, cordierite, carbon, and the like.

Figure 2:
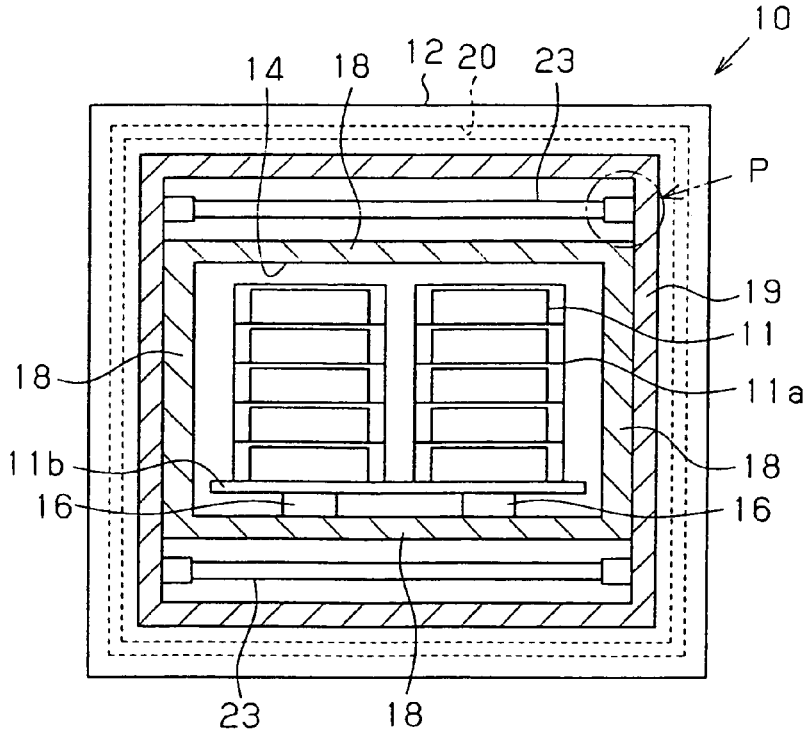
FIG. 2 is a cross-sectional view of the firing furnace taken along line 2-2 in FIG. 1.

A pretreatment chamber 13, a firing chamber 14, and a cooling chamber 15 are defined in the housing 12. A plurality of conveying rollers 16 for conveying the firing subjects 11 are arranged along the bottom surfaces of the chambers 13 to 15. As shown in FIG. 2, a support base 11*b* is mounted on the conveying rollers 16. The support base 11*b* supports a plurality of stacked firing jigs 11*a*. Firing subjects 11 are placed on each of the firing jigs 11*a*. The support base 11*b* is pushed from the loading port 13*a* towards the unloading port 15*a*. The firing subjects 11, the firing jigs 11*a*, and the support base 11*b* are conveyed, by the rolling of the conveying rollers 16, through the pretreatment chamber 13, the firing chamber 14, and the cooling chamber 15 sequentially in this order.

An example of a firing subject 11 is a molded product formed by compression molding a ceramic material. The firing subject 11 is treated in the housing 12 as it moves at a predetermined speed. The firing subject 11 is fired when passing through the firing chamber 14. Ceramic powder, which forms each firing subject 11, is sintered during the conveying process to produce a sinter. The sinter is conveyed into the cooling chamber 15 and cooled down to a predetermined temperature. The cooled sinter is discharged from the unloading port 15*a*.

The structure of the firing furnace 10 will now be described.

FIG. 2 is a cross-sectional view taken along line 2-2 in FIG. 1. As shown in FIG. 2, furnace walls 18 define an upper surface, a lower surface, and two side surfaces of the firing chamber 14. The furnace walls 18 and the firing jigs 11*a* are formed of a high heat resistant material such as carbon.

A heat insulative layer 19 formed of carbon fibers or the like is arranged in the housing 12. A water-cooling jacket 20 is embedded in the housing 12 for circulating cooling water. The heat insulative layer 19 and the water-cooling jacket 20 prevent metal components of the housing 12 from being deteriorated or damaged by the heat of the firing chamber 14.

A plurality of rod heaters (resistance heating elements) 23 are arranged on the upper side and lower side of the firing chamber 14, or arranged so as to sandwich the firing subjects 11, in the firing chamber 14. In the embodiment, the rod heaters 23 are each cylindrical and has a longitudinal axis extending in the lateral direction of the housing 12 (in the direction orthogonal to the conveying direction of the firing subjects 11). The rod heaters 23 are held between opposite walls of the housing 12. The rod heaters 23 are arranged parallel to each other in predetermined intervals. The rod heaters 23 are arranged throughout the firing chamber 14 from the entering position to the exiting position of the firing subjects 11.

An example of a material for forming the rod heater 23 is a ceramics material such as carbon having superior heat resistance. The preferred ceramics material is graphite that particularly has high heat resistance and that can easily be machined.

Figure 3:
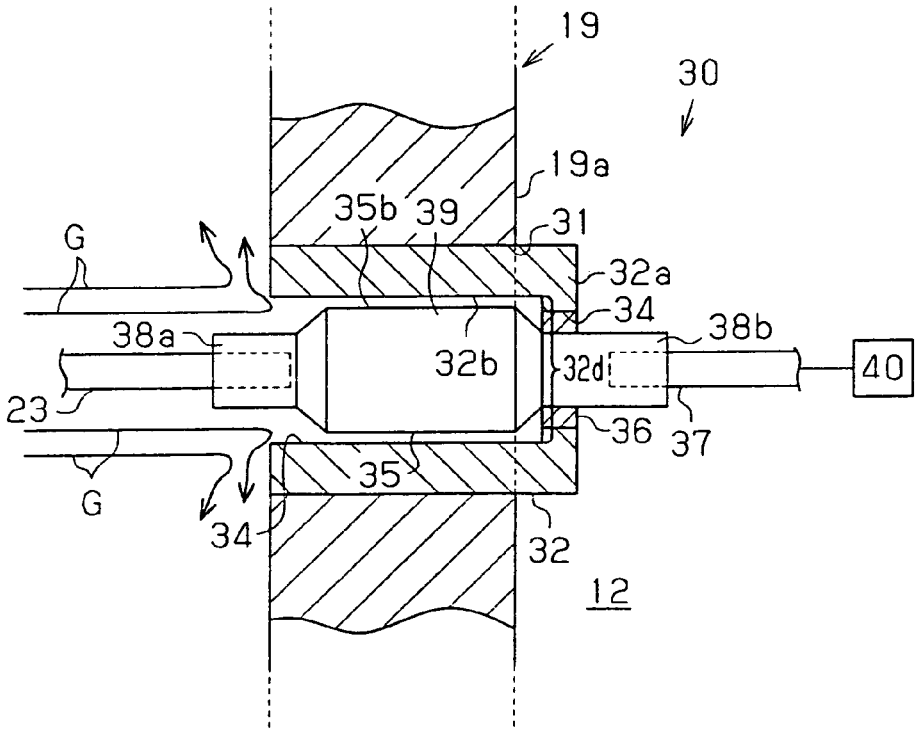
FIG. 3 is an enlarged cross-sectional view of an electrode part in the firing furnace.

A power feeding unit 30 for feeding current to the rod heater 23 will now be described. FIG. 3 is an enlarged cross-sectional view taken at portion P in FIG. 2.

As shown in FIG. 3, the housing 12 has an inner surface along which a heat insulative layer 19 is applied. A plurality of fixing holes 31 for fixing the rod heaters 23 are formed in the heat insulative layer 19. A cylindrical fixing member 32 is fitted to each fixing hole 31. The fixing member 32 has an end 32*a* exposed from the outer surface 19*a* of the heat insulative layer 19. The fixing member 32 includes an insertion hole 34 for receiving a connector 35.

The connector 35 connects a metal electrode member 37, which is directly or indirectly connected to an external power supply 40, and a rod heater 23, which is arranged inside the housing 12. The connector 35 has one end, or a first connecting portion 38*a*, located inside the housing 12, and another end, or a second connecting portion 38*b*, located outside the housing 12. The connector 35 also has a cylindrical enlarged diameter portion (restriction structure) 39 that is larger than other parts of the connector 35. Female threads are formed in the first and the second connecting portions 38*a* and 38*b* of the connector 35. Male threads screw are formed on the rod heater 23 and the electrode member 37 at portions connected to the first and the second connecting portions 38*a* and 38*b* of the connector 35, respectively. The rod heater 23 and the electrode member 37 are respectively mated with the first and the second connecting portions 38*a* and 38*b* of the connector 35 so as to electrical connect the rod heater 23 and the electrode member 37.

The end 32*a* of the fixing member 32 includes an inwardly extending lip 32*d*. An annular insulative member 36 seals the gap between the lip 32*d* and the connector 35. The insulative member 36 and the end 32*a* of the fixing member 32 are arranged outward from the outer surface 19*a* of the heat insulative layer 19. The insulative member 36 is spaced from the heat insulative layer 19 by about 10 to about 100 mm, preferably, by about 20 to about 100 mm. If the spaced distance is in the range of about 10 to about 100 mm, the durability prolonging effect of the insulative member 36 is improved since hot gas G inside the housing 12 is not likely to reach the insulative member 36. And, it may not become difficult to ensure space for installing the power feeding unit 30 due to the prevention of enlargement of the fixing member 32.

An example of a material for forming the fixing member 32 and the connector 35 is a material having high heat-resistance such as carbon. The preferred material is graphite, which has superior heat-resistance and corrosion-resistance and is easily machined. An example of a material for forming the insulative member 36 is boron nitride (BN), which has a superior insulation property under high temperatures.

The enlarged diameter portion (restriction structure) 39 of the connector 35 partially reduces the distance between the outer circumferential surface 35*b* of the connector 35 and the inner circumferential surface 32*b* of the fixing member 32. The restriction structure 39 restricts the flow of hot gas G generated inside the housing 12 that directly reaches the insulative member 36. In the example of FIG. 3, the restriction structure 39 restricts the flow of hot gas G that enters the gap between the fixing member 32 and the connector 35. The hot gas G is a volatile component (derived from binder contained in the firing subjects 11) or foreign material produced when the firing subject 11 is fired under high temperatures.

Figure 4:
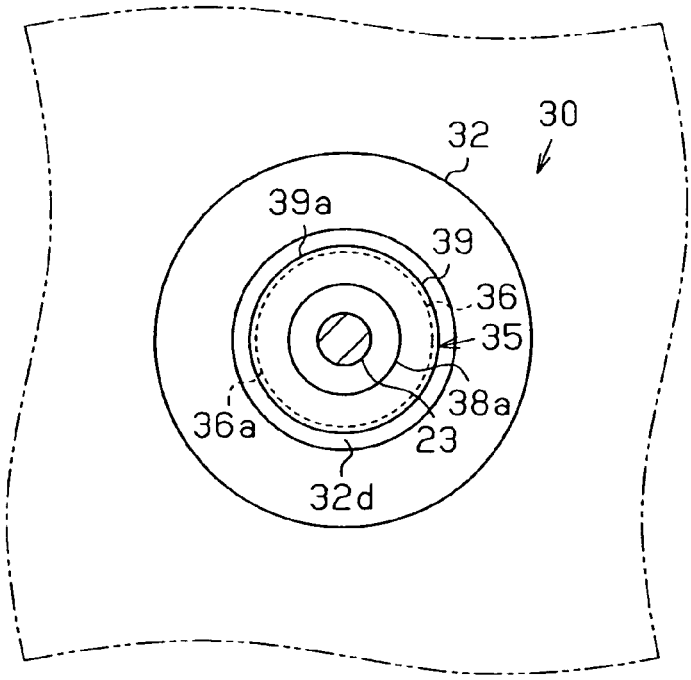
FIG. 4 is a front view showing the electrode part from the interior of the firing furnace.

FIG. 4 is a plan view showing the power feeding unit 30 taken from the inside of the housing 12. The periphery 39*a* of the restriction structure 39 is located outward from the periphery 36*a* of the insulative member 36. That is, the diameter of the restriction structure 39 is greater than the diameter of the insulative member 36, and the insulative member 36 is completely hidden by the restriction structure 39.

The first embodiment has the advantages described below.

(1) The restriction structure 39 is formed at the central portion of the connector 35. The restriction structure 39 meanders the flow of hot gas G in the gap between the outer circumferential surface 35*b* of the connector 35 and the inner circumferential surface 32*b* of the fixing member 32, shortens the distance between the two members 32 and 35, and suppresses the flow of hot gas G flowing towards the insulative member 36. Deterioration or fusion of the insulative member 36 caused by the hot gas G is suppressed by effectively preventing the flow of hot gas G in the housing 12 from directly contacting the insulative member 36. This prolongs the durability of the insulative member 36. Thus, there would be no frequently exchange the insulative member 36. This improves the operation efficiency of the firing furnace 10.

(2) When viewed from the inner side of the housing 12, the restriction structure 39 is arranged so as to completely hide the insulative member 36. This suppresses the flow of hot gas G towards the insulative member 36. The flow of hot gas G in the housing 12 is effectively prevented from directly contacting the insulative member 36. This prolongs the durability of the insulative member 36.

(3) The restriction structure 39 is formed by partially changing the shape of the connector 35. Thus, the configuration of the power feeding unit 30 does not need to be greatly changed, and most of the conventional configuration may be used without any changes. Thus, the durability of the insulative member 36 is prolonged without large designing modifications.

Figure 7:
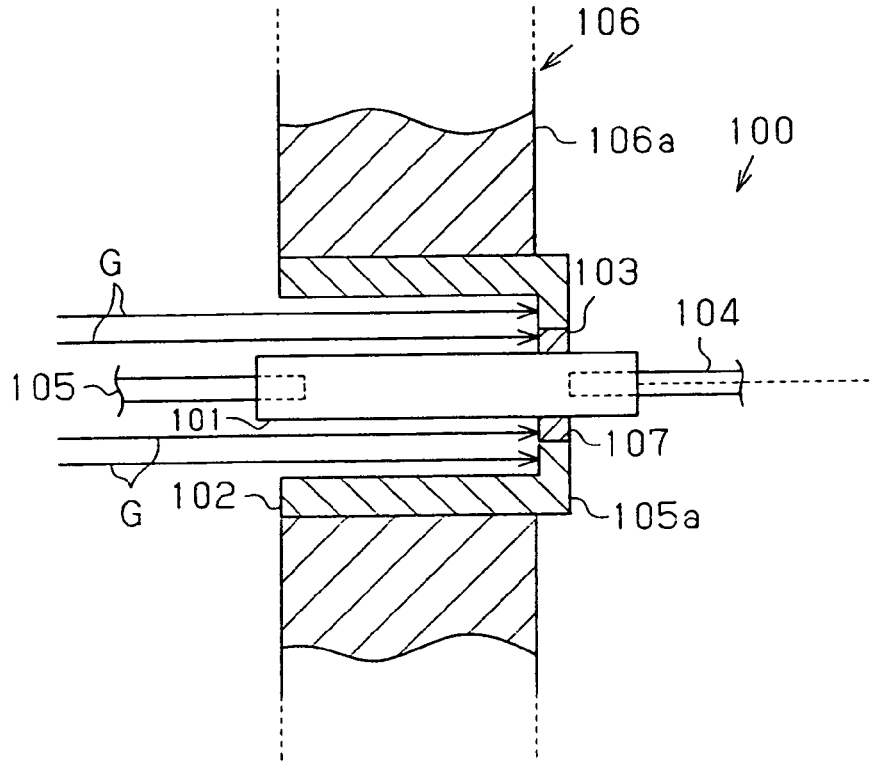
FIG. 7 is a partial cross-sectional view of an electrode part in a conventional firing furnace.

(4) The cross-sectional area of the connector 35 is greater than that of the conventional configuration shown in FIG. 7 due to the enlarged diameter at the central portion of the connector 35. Deterioration or damage and the like caused by resistance heating of the connector 35 is reduced since the electrical resistance value of the connector 35 is decreased and the generation of heat by the resistance of the connector 35 is lowered. Therefore, in addition to the insulative member 36, the durability of the connector 35 is prolonged.

(5) The end 32*a* of the fixing member 32 is arranged outward from the outer surface 19*a* of the heat insulative layer 19, and the insulative member 36 is attached to the end 32*a* . Thus, the insulative member 36 is spaced as much as possible from the internal space of the housing 12 that is under the atmosphere of hot gas G. This increases the distance required for the hot gas G to reach the insulative member 36 and suppresses the heat transmission from the housing 12 to the insulative member 36. The flow of hot gas G in the housing 12 is effectively prevented from directly contacting the insulative member 36. This suppresses deterioration or fusion of the insulative member 36 caused by the hot gas G.

(6) The firing furnace 10 is a continuous firing furnace in which the firing subjects 11 that enter the housing 12 are continuously sintered in the firing chamber 14. When mass-producing ceramic products, the employment of the continuous firing furnace drastically improves productivity in comparison with a conventional batch firing furnace.

A power feeding unit 50 according to a second embodiment will now be described with reference to FIG. 5. The connector 45 includes a projection (enlarged diameter portion) 49*a* formed in part of the outer surface 45*b*. The fixing member 42 has an inner surface 42*b*, which defines a relatively large space for accommodating the projection 49*a* of the connector 45, and a projection 49*b*, which is formed on an inner surface that defines a relatively small space for accommodating portions of the connector 45 other than the projection 49*a*. The projection 49*a* of the connector 45 projects towards the inner surface 42*b* of the fixing member 42. The projection 49*b* of the fixing member 42 projects towards the outer surface 45*b* of the connector 45, excluding the projection 49*a*. The projections 49*a* and 49*b* form an angled narrow space between the connector 45 and the fixing member 42 and function as a restriction structure. With the restriction structure, the flow of hot gas G in the housing 12 is effectively prevented from directly contacting the insulative member 36. Thus, deterioration or fusion of the insulative member 36 by the hot gas G is reliably suppressed. This prolongs the durability of the insulative member 36. The projection 49*a* of the connector 45 may be omitted. In such a case, deterioration and fusion of the insulative member 36 caused by hot gas G would still be suppressed by the projection 49*b* of the fixing member 42.

Figure 6:
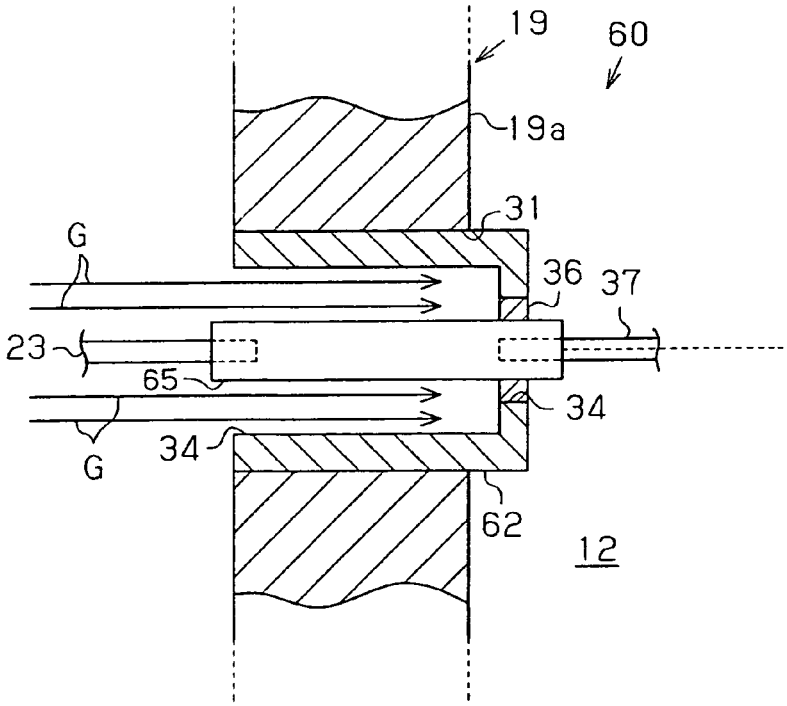
FIG. 6 is a partial cross-sectional view of an electrode part in a firing furnace according to a third embodiment of the present invention.

A third embodiment will now be described with reference to FIG. 6. As shown in FIG. 6, a power feeding unit 60 includes a cylindrical connector 65, a fixing member 62 covering the connector 65, and an insulative member 36 for electrically insulating the connector 65 and the fixing member 62. The fixing member 62 has an end 62*a* located outward from the outer surface 19*a* of the heat insulative layer 19. The insulative member 36 is attached to the end 62*a*. The end 62*a*, which is arranged outward from the outer surface 19*a* of the heat insulative layer 19, functions as the restriction structure. The hot gas G in the housing 12 is prevented from directly contacting the insulative member 36 by maximizing the distance of the insulative member 36 from the internal space of the housing 12, which is under the atmosphere of hot gas G.

The method for manufacturing a porous ceramic fired object with a firing furnace according to a preferred embodiment of the present invention will now be described.

A porous ceramic fired object is manufactured by molding sintering material to prepare a molded product and sintering the molded product (fired subject). Examples of the sintering material include nitride ceramics, such as aluminum nitride, silicon nitride, boron nitride, and titanium nitride; carbide ceramics, such as silicon carbide, zirconium carbide, titanium carbide, tantalum carbide, and tungsten carbide; oxide ceramics such as alumina, zirconia, cordierite, mullite, and silica;

mixtures of several sintering materials such as a composite of silicon and silicon carbide; and oxide and non-oxide ceramics containing plural types of metal elements such as aluminum titanate.

A preferable porous ceramic fired object is a porous non-oxide fired object having high heat resistance, superior mechanical characteristics, and high thermal conductivity. A particularly preferable porous ceramic fired object is a porous silicon carbide fired object. A porous silicon carbide fired object is used as a ceramic member, such as a particulate filter or a catalyst carrier, for purifying (converting) exhaust gas from an internal combustion engine such as a diesel engine.

A particulate filter will now be described.

Figure 8:
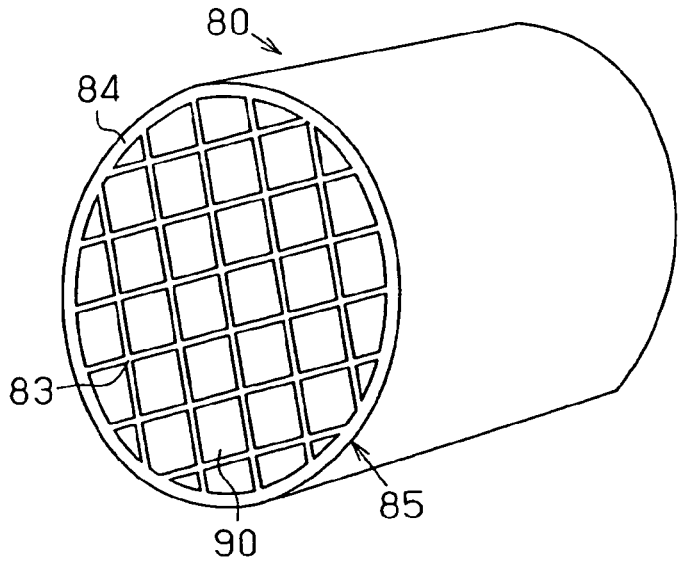
FIG. 8 is a perspective view showing a particulate filter for purifying exhaust gas.
Figure 9A:
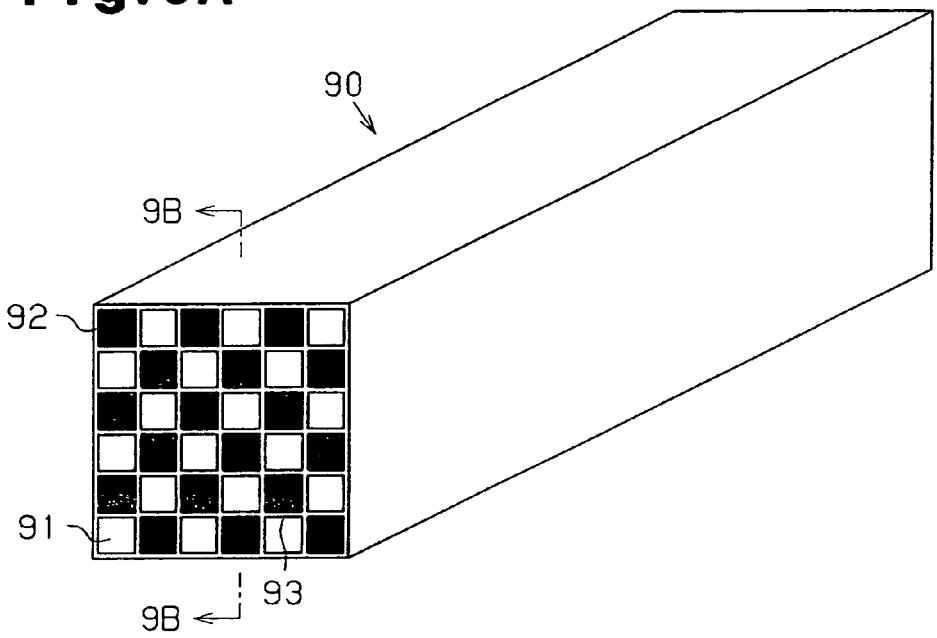
FIGS. 9(A) and (B) are respectively a perspective view and a cross-sectional view showing a ceramic member used to manufacture the particulate filter of FIG. 8.

FIG. 8 shows a particulate filter (honeycomb structure) 80. The particulate filter 80 is manufactured by binding a plurality of porous silicon carbide fired objects, or ceramic members 90 shown in FIG. 9(A). The ceramic members 90 are bonded to each other by a bonding layer 83 to form a single ceramic block 85. The shape and dimensions of the ceramic block 85 are adjusted in accordance with its application. For example, the ceramic block 85 is cut to a length in accordance with its application and trimmed into a shape (e.g., cylindrical pillar, elliptic pillar, or rectangular pillar) that is in accordance with its application. The side surface of the shaped ceramic block 85 is covered with a coating layer 84.

Figure 9B:
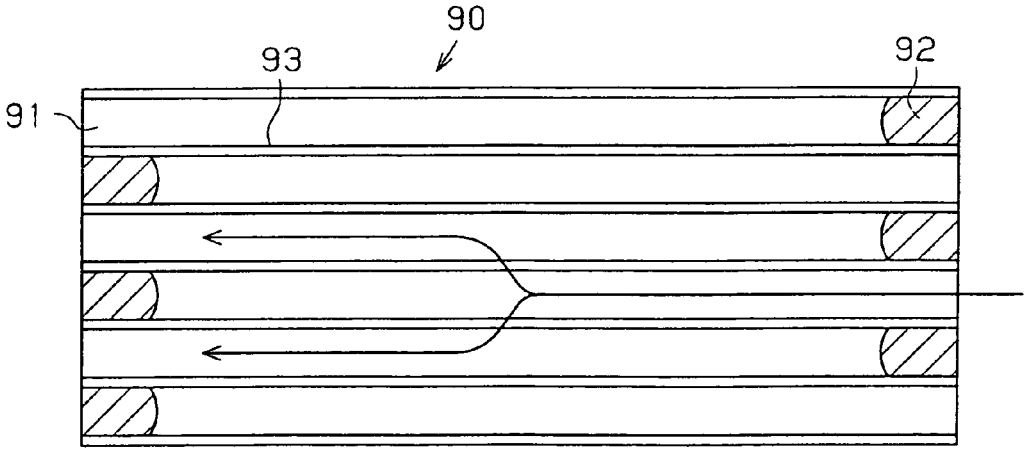

As shown in FIG. 9(B), each ceramic member 90 includes partition walls 93 defining a plurality of gas passages 91, which extend longitudinally. At each end of the ceramic member 90, the openings of the gas passages 91 are alternately closed by sealing plugs 92. More specifically, each gas passage 91 has one end closed by the sealing plug 92 and another end that is open. Exhaust gas flows into a gas passage 91 from one end of the particulate filter 80, passes through the partition wall 93 into an adjacent gas passage 91, and flows out from the other end of the particulate filter 80. When the exhaust gas passes through the partition wall 93, particulate matter (PM) in the exhaust gas are trapped by the partition wall 93. In this manner, purified exhaust gas flows out of the particulate filter 80.

The particulate filter 80, which is formed of a silicon carbide fired object, has extremely high heat resistance and is easily regenerated. Therefore, the particulate filter 80 is suitable for use in various types of large vehicles and diesel engine vehicles.

The bonding layer 83, for bonding the ceramic members 90, functions as a filter for removing the particulate matter (PM). The material of the bonding layer 83 is not particularly limited but is preferably the same as the material of the ceramic member 90.

The coating layer 84 prevents leakage of exhaust gas from the side surface of the particulate filter 80 when the particulate filter 80 is installed in the exhaust gas passage of an internal combustion engine. The material for the coating layer 84 is not particularly limited but is preferably the same as the material of the ceramic member 90.

Preferably, the main component of each ceramic member 90 is silicon carbide. The main component of the ceramic member 90 may be silicon-containing ceramics obtained by mixing silicon carbide with metal silicon, ceramics obtained by combining silicon carbide with silicon or silicon oxychloride, aluminum titanate, carbide ceramics other than silicon carbide, nitride ceramics, or oxide ceramics.

When about 0 to about 45% by weight of metal silicon with respect to the ceramic member 90 is contained in the firing material, some or all of the ceramic powder is bonded together with the metal silicon. Therefore, the ceramic member 90 has high mechanical strength.

The preferable average pore size for the ceramic member 90 is about 5 to about 100 μm. If the average pore size is in the range of about 5 to about 100 μm, the ceramic member 90 may not be clogged with exhaust gas and can collect particulate matter in the exhaust gas without allowing the particulate matter passing through the partition walls 93 of the ceramic member 90.

The porosity of the ceramic member 90 is not particularly limited but is preferably about 40 to about 80%. The ceramic member 90 having a porosity in a range between about 40 to about 80% can not be clogged with exhaust gas and the mechanical strength of the ceramic member 90 is improved and thus the ceramic member 90 will not be easily damaged.

A preferable firing material for producing the ceramic member 90 is ceramic particles. It is preferable that the ceramic particles have a low degree of shrinkage during firing. A particularly preferable firing material for producing the particulate filter 50 is a mixture of 100 parts by weight of relatively large ceramic particles having an average particle size of about 0.3 to about 50 μm and about 5 to about 65 parts by weight of relatively small ceramic particles having an average particle size of about 0.1 to about 1.0 μm.

The shape of the particulate filter 80 is not limited to a cylindrical shape and may have an elliptic pillar shape or a rectangular pillar shape.

The method for manufacturing the particulate filter 80 will now be described.

A firing composition (material), which contains silicon carbide powder (ceramic particles), a binder, and a dispersing solvent, is prepared with a wet type mixing mill such as an attritor. The firing composition is sufficiently kneaded with a kneader and molded into a molded product (firing subject 11) having the shape of the ceramic member 90 shown in FIG. 9(A) (hollow square pillar) by performing, for example, extrusion molding.

The type of the binder is not particularly limited but is normally methyl cellulose, carboxymethyl cellulose, hydroxyethyl cellulose, polyethylene glycol, phenolic resin, or epoxy resin. The preferred amount of the binder is about 1 to about 10 parts by weight relative to 100 parts by weight of silicon carbide powder.

The type of the dispersing solvent is not particularly limited but is normally a water-insoluble organic solvent such as benzene, a water-soluble organic solvent such as methanol, or water. The preferred amount of the dispersing solvent is determined such that the viscosity of the firing composition is within a certain range.

The firing subject 11 is dried. One of the openings is sealed in some of the gas passages 91 as required. Then, the firing subject 11 is dried again.

A plurality of the firing subjects 11 is dried and placed in the firing jigs 11*a*. A plurality of the firing jigs 11*a* are stacked on the support base 11*b*. The support base 11*b* is moved by the conveying rollers 16 and passes through the firing chamber 14. While passing through the firing chamber 14, the firing subjects 11 are fired thereby manufacturing the porous ceramic member 90.

A plurality of the ceramic members 90 are bonded together with the bonding layers 83 to form the ceramic block 85. The dimensions and the shape of the ceramic block 85 are adjusted in accordance with its application. The coating layer 84 is formed on the side surface of the ceramic block 85. This completes the particulate filter 80.

The present invention will be described in further detail through examples. However, the present invention is not limited to the following examples.

EXAMPLES 1 to 7 and COMPARATIVE EXAMPLE 1

The firing furnaces of examples 1 to 3 include the power feeding unit 30 shown in FIG. 3. The firing furnaces of examples 4 to 6 include a power feeding unit 50, which is shown in FIG. 5. The firing furnace of example 7 includes a power feeding unit 60, which is shown in FIG. 6. The firing furnace of comparative example 1 includes a power feeding unit 100, which is shown in FIG. 7.

Each power feeding unit 30, 50, 60, 100 was installed at a predetermined location in the housing 12, and power was supplied to the firing furnace 10 was performed over a long period of time to evaluate the effect that the restriction structures 39, 49*a*, and 49*b* have over the prolongation of the durability of the insulative member 36. The influence of the position of the insulative member 36, or the distance from the heat insulative layer 19, over the prolongation of the durability of the insulative member 36 was also evaluated. The temperature inside the furnace was about 2200° C., and a test was conducted by supplying power to the firing furnace 10 with the interior of the furnace in an argon (Ar) atmosphere. Deterioration and damage of the insulative member 36 was visually checked when 2000 hours elapsed and when 4000 hours elapsed to evaluate the durability of the insulative member 36. The evaluation results, the outer diameter of the connectors 35, 45, 65, and 101 used in examples 1 to 7 and comparative example 1, the inner diameter of the fixing members 32, 42, 62, and 102, the dimension of the gap formed between the two members, and the position (distance from the heat insulative layer 19) of the insulative member 36 are shown in table 1.

As apparent from table 1, in the cases of examples 1 to 7, damage of the insulative member 36 was prevented even if used for 4000 hours under an atmosphere in which the hot gas G is 2200° C. In the case of comparative example 1, damage of the insulative member 36 was confirmed when used for 2000 hours under an atmosphere in which the hot gas G is 2200° C. It is assumed that damage of the insulative member 36 would have been prevented in examples 1 to 6 based on the fact that the hot gas G in the housing 12 was less likely to have directly contacted the insulative member 36 due to the restriction structures 39, 49*a*, and 49*b* thereby suppressing fusion and deterioration caused by the hot gas G. Further, in example 7, the insulative member 36 is arranged at the outer side of the heat insulative layer 19, that is, a position distant from the interior of the housing 12. Thus, in the same manner as in examples 1 to 6, it is difficult for the hot gas G in the housing 12 to directly contact the insulative member 36. It is therefore assumed that fusion or deterioration caused by the hot gas G was suppressed and prevented damages from being inflicted on the insulative member 36.

Accordingly, to prolong the durability of the insulative member 36, it was confirmed from examples 1 to 7 that it is preferable to arrange the restriction structures 39, 49*a*, and 49*b* in the direction gas flows from the housing 12 to the insulative member 36 or to separate the insulative member 36 from the interior of the housing 12. Further, to prolong the durability, it was confirmed from examples 1 to 3 and examples 4 to 6 that it is preferable for the distance between the insulative member 36 and the heat insulative layer 19 to be greater than or equal to 10 mm, and more preferably, greater than or equal to 20 mm.

TABLE 1

Figure 5:
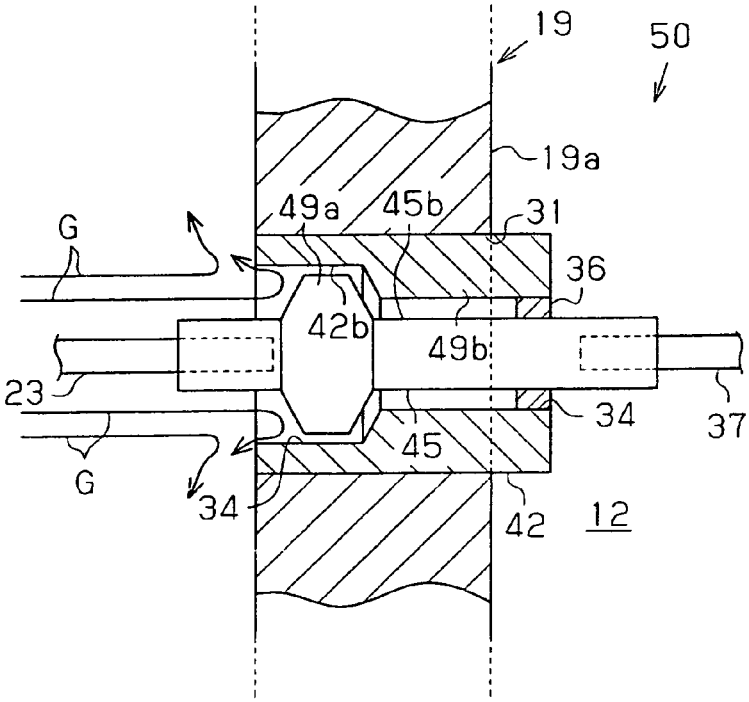
FIG. 5 is a partial cross-sectional view of an electrode part in a firing furnace according to a second embodiment of the present invention.

| | | Connector Shape | | Sleeve Shape | | Position of Insulative Member | State of Insulative Member | |
|---|---|---|---|---|---|---|---|---|
| | Referential Drawing | Diameter of Connection Portion (mm) | Diameter of Restriction Portion (mm) | Inner Diameter of Sleeve (mm) | Gap (mm) | Distance from Insulative Material (mm) | Usage After 2000 hrs, 2200 degree C. | Usage After 4000 hrs, 2200 degree C. |
| Ex. 1 | FIG. 3 | 70 | 85 | 110 | 12.5 | 20 | No Damage, No Deterioration | No Damage, No Deterioration |
| Ex. 2 | FIG. 3 | 70 | 85 | 110 | 12.5 | 10 | No Damage, No Deterioration | No Damage, Slight Deterioration Confirmed |
| Ex. 3 | FIG. 3 | 70 | 85 | 110 | 12.5 | 0 | No Damage, Slight Deterioration Confirmed | No Damage, Slight Deterioration Confirmed |
| Ex. 4 | FIG. 5 | 70 | 85 | 110<br>95<br>(Restriction Portion) | 12.5 | 20 | No Damage, No Deterioration | No Damage, No Deterioration |
| Ex. 5 | FIG. 5 | 70 | 85 | 110<br>95<br>(Restriction Portion) | 12.5 | 10 | No Damage, No Deterioration | No Damage, Slight Deterioration Confirmed |
| Ex. 6 | FIG. 5 | 70 | 85 | 110<br>95<br>(Restriction Portion) | 12.5 | 0 | No Damage, Slight Deterioration Confirmed | No Damage, Slight Deterioration Confirmed |
| Ex. 7 | FIG. 6 | 70 | 70 | 110 | 20 | 20 | No Damage, Deterioration Confirmed | No Damage, Deterioration Confirmed |
| Comp. Ex. 1 | FIG. 7 | 70 | 70 | 110 | 20 | 0 | Damage Confirmed | Damage Confirmed |

EXAMPLE 8

A method for manufacturing the porous ceramic fired object with the firing furnaces of examples 1 to 7 will now be described.

A powder of α-type silicon carbide having an average particle size of 10 μm, 60% by weight, was wet mixed with a powder of α-type silicon carbide having an average particle size of 0.5 μm, 40% by weight. Five parts by weight of methyl cellulose, which functions as an organic binder, and 10 parts by weight of water were added to 100 parts by weight of the mixture and kneaded to prepare a kneaded mixture. A plasticizer and a lubricant were added to the kneaded mixture in small amounts and further kneaded. The kneaded mixture was then extruded to produce a silicon carbide molded product (firing subject).

The molded product was then subjected to primary drying for three minutes at 100° C. with the use of a microwave drier. Subsequently, the molded product was subjected to secondary drying for 20 minutes at 110° C. with the use of a hot blow drier.

The dried molded product was cut to expose the open ends of the gas passages. The openings of some of the gas passages were filled with silicon carbide paste to form sealing plugs 62.

Ten dried molded products (firing subjects) 11 were placed on a carbon platform, which was held on each of the carbon firing jigs 11*a*. Five firing jigs 11*a* were stacked on top of one another. The uppermost firing jig 11*a* was covered with a cover plate. Two such stacked bodies (stacked firing jigs 11*a*) were placed on the support base 11*b*.

The support base 11*b*, carrying the molded products 11, was loaded into a continuous degreasing furnace. The molded products 11 were degreased in an atmosphere of an air and nitrogen gas mixture having an oxygen concentration adjusted to 8% and heated to 300° C.

After the degreasing, the support base 11*b* was loaded into the continuous firing furnace 10. The molded products 11 were sintered for three hours at 2200° C. in an atmosphere of argon gas under atmospheric pressure to manufacture a porous silicon carbide sinter (ceramic member 60) having the shape of a square pillar.

Adhesive paste was prepared, containing 30% by weight of alumina fibers with a fiber length of 20 μm, 20% by weight of silicon carbide particles having an average particle size of 0.6 μm, 15% by weight of silicasol, 5.6% by weight of carboxymethyl cellulose, and 28.4% by weight of water. The adhesive paste is heat resistive. The adhesive paste was used to bond sixteen ceramic members 90 together in a bundle of four columns and four rows to produce a ceramic block 85. The ceramic block 85 was cut and trimmed with a diamond cutter to adjust the shape of the ceramic block 85. An example of the ceramic block 85 is a cylindrical shape having a diameter of 144 mm and a length of 150 mm.

A coating material paste was prepared by mixing and kneading 23.3% by weight of inorganic fibers (ceramic fibers such as alumina silicate having a fiber length of 5 to 100 μm and a shot content of 3%), 30.2% by weight of inorganic particles (silicon carbide particles having an average particle size of 0.3 μm), 7% by weight of an inorganic binder (containing 30% by weight of $SiO_2$ in sol), 0.5% by weight of an organic binder (carboxymethyl cellulose), and 39% by weight of water.

The coating material paste was applied to the side surface of the ceramic block 85 to form the coating layer 84 having a thickness of 1.0 mm, and the coating layer 84 was dried at 120° C. This completed the particulate filter 80.

The particulate filter 80 of example 8 satisfies various characteristics required for an exhaust gas purifying filter. Since a plurality of the ceramic members 90 are continuously sintered in the firing furnace 10 at a uniform temperature, the difference between the ceramic members 90 in characteristics, such as pore size, porosity, and mechanical strength, is reduced. Thus, the difference between the particulate filters 80 in characteristics is also reduced.

As described above, the firing furnace of the present invention is suitable for manufacturing porous ceramic fired objects.

It should be apparent to those skilled in the art that the present invention may be embodied in many other specific forms without departing from the spirit or scope of the invention. Particularly, it should be understood that the preferred embodiment and examples may be modified and embodied in the following forms.

The restriction structure 39 does not need to be arranged at a position completely hiding the insulative member 36 when viewed from the interior of the housing 12 and may be arranged at a position partially hiding the insulative member 36.

The restriction structure 39 and the connector 35 are formed integrally with each other. However, the restriction structure 39 may be formed as a separately from the connector 35.

The end 32*a* of the fixing member 32 may be arranged flush with the outer surface 19*a* of the heat insulative layer 19 or inward from the outer surface 19*a*. Deterioration or fusion of the insulative member 36 would still suppressed by the restriction structure 39 having such a configuration.

The connector 35 may be formed to have a shape other than a circular pillar such as the shape of a rectangular pillar, an elliptic pillar, and the like.

The fixing member 32 may be formed to have a shape other than a circular cylinder (can-type) such as a rectangular cylinder or an elliptic cylinder.

The rod heater 23 may be formed from a material other than graphite, such as, a silicon carbide ceramic heating element or a metal material like nichrome wire.

The firing subject 11 described above is generally box-shaped. However, the shape of the firing subject 11 is not limited, and the first embodiment is applicable to a firing subject 11 having any shape.

The firing furnace 10 does not have to be a continuous firing furnace and may be, for example, a batch firing furnace.

The firing furnace 10 may be used for purposes other than to manufacture ceramic products. For example, the firing furnace 10 may be used as a heat treatment furnace or reflow furnace used in a manufacturing process for semiconductors or electronic components.

In example 8, the particulate filter 80 includes a, plurality of filter elements 90 which are bonded to each other by the bonding layer 83 (adhesive paste). Instead, a single filter element 90 may be used as the particulate filter 80.

The coating layer 84 (coating material paste) may or may not be applied to the side surface of each of the filter elements 90.

In each end of the ceramic member 90, all the gas passages 91 may be left open without being sealed with the sealing plugs 92. Such a ceramic fired object is suitable for use as a catalyst carrier. An example of a catalyst is a noble metal, an alkali metal, an alkali earth metal, an oxide, or a combination of two or more of these components. However, the type of the catalyst is not particularly limited. The noble metal may be platinum, palladium, rhodium, or the like. The alkali metal may be potassium, sodium, or the like. The alkali earth metal may be barium or the like. The oxide may be a Perovskite oxide (e.g., $La_{0.75}K_{0.25}MnO_3$), $CeO_2$ or the like. A ceramic fired object carrying such a catalyst may be used, although not particularly limited in any manner, as a so-called three-way catalyst or NOx absorber catalyst for purifying (converting) exhaust gas in automobiles. After the manufacturing a ceramic fired object, the fired object may be carried in a ceramic fired object. Alternatively, the catalyst may be carried in the material (inorganic particles) of the ceramic fired object before the ceramic fired object is manufactured. An example of a catalyst supporting method is impregnation but is not particularly limited in such a manner.

The present examples and embodiments are to be considered as illustrative and not restrictive, and the invention is not to be limited to the details given herein, but may be modified within the scope and equivalence of the appended claims.

What is claimed is:

1. A firing furnace, connected to an external power supply, for firing a firing subject, the firing furnace comprising:

a housing including a firing chamber for accommodating the firing subject;

a plurality of heat generation bodies arranged in the housing and generating heat with power supplied from the external power supply to heat the firing subject in the firing chamber;

a connection member for electrically connecting the external power supply and each heat generation body;

a fixing member attached to the housing and including an insertion hole for receiving the connection member;

an insulative member for sealing a space between the insertion hole and the connection member; and a restriction structure, formed of an electrically conductive material, for restricting a flow of gas produced in the housing directed through a gap between the fixing member and the connection member and toward the insulative member, wherein the restriction structure is arranged so that the insulative member is hidden behind the restriction structure when viewed from an inner side of the housing.

2. The firing furnace according to claim 1, wherein the restriction structure is configured so as to restrict the flow of gas produced in the housing that enters the gap between the fixing member and the connection member.

3. The firing furnace according to claim 1, wherein the restriction structure includes at least one of a projection formed on an outer surface of the connection member and a projection formed on an inner surface of the fixing member.

4. The firing furnace according to claim 3, wherein the restriction structure is a projection formed on the outer surface of the connection member and projects towards the inner surface of the fixing member.

5. The firing furnace according to claim 3, wherein the restriction structure includes a projection extending along the outer surface of the connection member in the circumferential direction and a projection formed along the entire circumference of the inner surface of the fixing member.

6. The firing furnace according to claim 1, wherein the restriction structure is configured to partially reduce the gap between the fixing member and the connection member.

7. The firing furnace according to claim 1, wherein the housing includes a heat insulative layer, and the insulative member is arranged outward from the heat insulative layer.

8. The firing furnace according to claim 1, wherein the housing includes a heat insulative layer, with part of the fixing member, the insulative member, and one end of the connection member being arranged outward from the heat insulative layer.

9. The firing furnace according to claim 1, wherein the housing includes a heat insulative layer, and the fixing member has an end arranged outward from the heat insulative layer, the end including an inwardly extending lip for supporting the insulative member at a location outward from the heat insulative layer, wherein the restriction structure includes the inward lip.

10. The firing furnace according to claim 7, wherein the insulative member is separated from the heat insulative layer by about 10 to about 100 mm.

11. The firing furnace according to claim 1, wherein the furnace is a continuous firing furnace for continuously firing a plurality of the firing subjects.

12. The firing furnace according to claim 1, wherein the restriction member is formed integrally with the connector and formed of carbon.

13. The firing furnace according to claim 12, wherein the restriction member and the connector are formed of graphite.

14. The firing furnace according to claim 1, wherein:

the connector has a first end portion connected to each heat generation body, and a second end portion connected to the external power supply;

the insulative member seals a space between the insertion hole and the second end portion of the connection member; and the restriction structure is an enlarged diameter portion of the connector formed between the one end and the another end of the connector.

15. A method for manufacturing a porous ceramic fired object, the method comprising:

forming a firing subject from a composition containing ceramic powder; and firing the firing subject with a firing furnace including a housing having a firing chamber for accommodating the firing subject, a plurality of heat generation bodies arranged in the housing and generating heat with power supplied from an external power supply to heat the firing subject in the firing chamber, a connection member for electrically connecting the external power supply and each heat generation body, a fixing member attached to the housing and including an insertion hole for receiving the connection member, an insulative member for sealing a space between the insertion hole and the connection member, and a restriction structure, formed of an electrically conductive material, for restricting a flow of gas produced in the housing directed through a gap between the fixing member and the connection member and toward the insulative member.

16. The method for manufacturing a porous ceramic fired object according to claim 15, wherein the restriction structure is configured so as to restrict the flow of gas produced in the housing that enters the gap between the fixing member and the connection member.

17. The method for manufacturing a porous ceramic fired object according to claim 15, wherein the restriction structure is arranged so that the insulative member is hidden behind the restriction structure when viewed from an inner side of the housing.

18. The method for manufacturing a porous ceramic fired object according to claim 15, wherein the restriction structure includes at least one of a projection formed on an outer surface of the connection member and a projection formed on an inner surface of the fixing member.

19. The method for manufacturing a porous ceramic fired object according to claim 18, wherein the restriction structure is a projection formed on the outer surface of the connection member and projected towards the inner surface of the fixing member.

20. The method for manufacturing a porous ceramic fired object according to claim 18, wherein the restriction structure includes a projection extending along the outer surface of the connection member in the circumferential direction and a projection formed along the entire circumference of the inner surface of the fixing member.

21. The method for manufacturing a porous ceramic fired object according to claim 15, wherein the restriction structure is configured to partially reduce the gap between the fixing member and the connection member.

22. The method for manufacturing a porous ceramic fired object according to claim 15, wherein the housing includes a heat insulative layer, and the insulative member is arranged outward from the heat insulative layer.

23. The method for manufacturing a porous ceramic fired object according to claim 15, wherein the housing includes a heat insulative layer, with part of the fixing member, the insulative member, and one end of the connection member being arranged outward from the heat insulative layer.

24. The method for manufacturing a porous ceramic fired object according to claim 15, wherein the housing includes a heat insulative layer, and the fixing member has an end arranged outward from the heat insulative layer, the end including an inwardly extending lip for supporting the insulative member at a location outward from the heat insulative layer, wherein the restriction structure includes the inward lip.

25. The method for manufacturing a porous ceramic fired object according to claim 22, wherein the insulative member is separated from the heat insulative layer by about 10 to about 100 mm.

26. The method for manufacturing a porous ceramic fired object according to claim 15, wherein the firing furnace is a continuous firing furnace, and the step of firing includes continuously firing a plurality of the firing subjects.

27. The method according to claim 15, wherein the restriction member is formed integrally with the connector and formed of carbon.

28. The method according to claim 27, wherein the restriction member and the connector are formed of graphite.

29. The method according to claim 15, wherein:

the connector has a first end portion connected to each heat generation body, and a second end portion connected to the external power supply;

the insulative member seals a space between the insertion hole and the second end portion of the connection member; and the restriction structure is an enlarged diameter portion of the connector formed between the one end and the another end of the connector.

* * * * *